US007644464B2

(12) United States Patent
Bommarito

(10) Patent No.: US 7,644,464 B2
(45) Date of Patent: Jan. 12, 2010

(54) CAULK TOOL

(76) Inventor: Joseph W. Bommarito, 5866 Howard Rd., Petoskey, MI (US) 49770

( * ) Notice: Subject to any disclaimer, the term of this patent is extended or adjusted under 35 U.S.C. 154(b) by 291 days.

(21) Appl. No.: 11/271,721

(22) Filed: Nov. 11, 2005

(65) Prior Publication Data

US 2006/0104704 A1 May 18, 2006

Related U.S. Application Data

(60) Provisional application No. 60/628,750, filed on Nov. 17, 2004.

(51) Int. Cl.
*A46B 15/00* (2006.01)

(52) U.S. Cl. ..... 15/105; 15/235.7

(58) Field of Classification Search ..... 15/111, 15/235.7, 105, 236.09; 401/266, 129
See application file for complete search history.

(56) References Cited

U.S. PATENT DOCUMENTS

| | | | | |
|---|---|---|---|---|
| 5,622,728 | A * | 4/1997 | Kartler | 425/87 |
| 5,992,022 | A * | 11/1999 | Carrera Moya | 30/113 |
| 7,073,691 | B2 * | 7/2006 | Rumrill et al. | 222/391 |
| 7,100,230 | B2 * | 9/2006 | Hillenbrand | 7/156 |
| 2004/0042843 | A1 * | 3/2004 | Hunt et al. | 401/289 |

* cited by examiner

*Primary Examiner*—Shay L Karls
(74) *Attorney, Agent, or Firm*—Brooks Kushman P.C.

(57) ABSTRACT

A caulk tool has a finishing head at one end of a handheld main body, and a cutting mechanism located near the other end. The finishing head can include a bristle structure used for smoothing out caulk and sealants. The cutting mechanism may include a push button blade for cutting tips of caulk and sealant tubes to a desired length and angle.

20 Claims, 3 Drawing Sheets

CAULK TOOL

CROSS-REFERENCE TO RELATED APPLICATIONS

This application claims the benefit of U.S. provisional application Ser. No. 60/628,750, filed Nov. 17, 2004, which is hereby incorporated herein by reference.

BACKGROUND OF THE INVENTION

1. Field of the Invention

The present invention relates to a tool for smoothing out caulk, sealants, and other like materials used, for example, in the construction industry.

2. Background Art

Many different approaches have been used for smoothing out caulk and other like materials. These include using a wet finger, sponge, rag, and even plastic trowels. While any of these may be acceptable in a given situation, none works well in a variety of situations. Therefore, a need exists for a caulk device that is simple, efficient, and versatile over a wide range of materials.

In addition to the problem of finishing the caulk after it is applied, another issue that needs to be addressed is opening a tube of caulk. Utility knives utilizing razor blades, pocket knives, and a variety of other cutting devices may be used in the field to cut the tip off a tube of caulk. Depending on the type of cutter used, its sharpness, and even the skill of the user, the caulk tube, at best, may not be cut correctly to facilitate application of a properly sized bead of caulk. At worst, using razor blades or other exposed cutting edges may lead to injury. Therefore, a need exists to provide a safe and effective mechanism for cutting off the end of a caulk tube.

SUMMARY OF THE INVENTION

Figure 1:
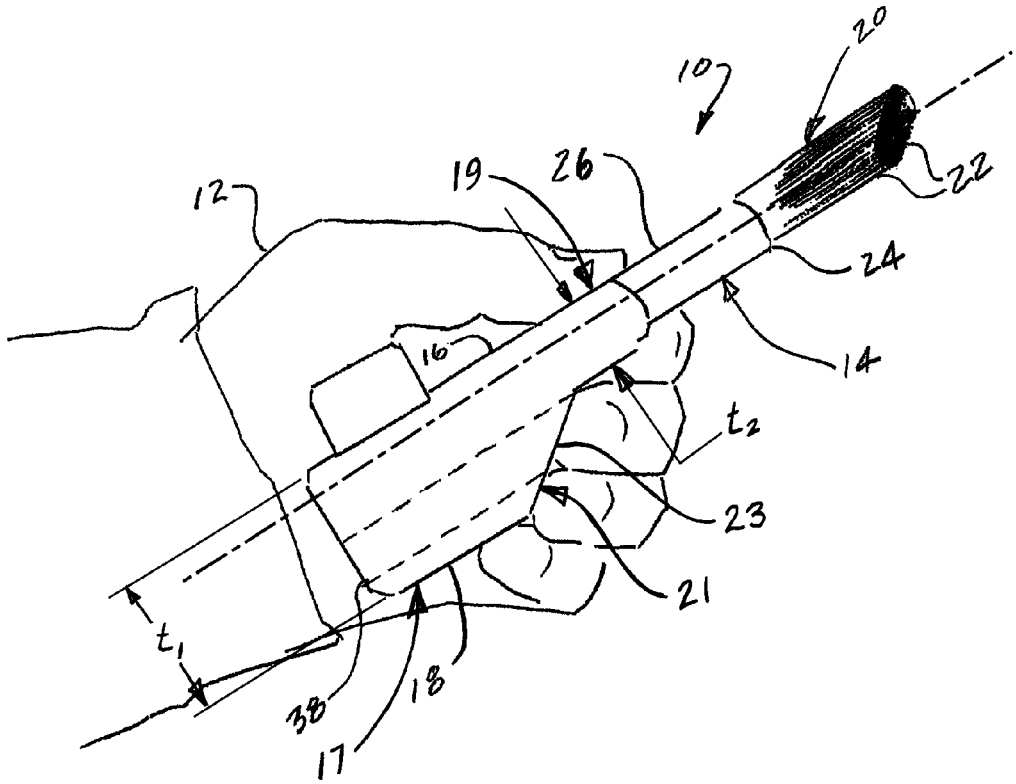
FIG. 1 is a perspective view of a tool in accordance with one embodiment of the present invention, shown in a user's hand.

The present invention provides a caulk tool that is simple to use, efficient, and versatile over a wide range of materials to apply a finish to a bead of caulk.

The invention also provides a caulk tool having a cutting mechanism for removing the tip of a caulk tube safely and effectively.

The invention further provides a caulk tool including a tool body and a cutter arrangement at least partially disposed within the tool body. The cutter arrangement includes a cutting blade for removing a portion of a caulk dispenser. A finishing head is configured to be applied to a bead of caulk, thereby providing a finished appearance to the caulk.

In one embodiment of the present invention, the tool body includes a first portion and a second portion adjacent the first portion, the first portion including the finishing head extending outwardly from one end thereof, and the second portion including a first aperture configured to receive a dispensing end of a caulk tube to facilitate removal of a portion of the dispensing end. The first aperture can have two at least partially open ends such that the dispensing end of a caulk tube can be inserted into one end of the first aperture, and a removed portion of the dispensing end can exit the tool body through the other end of the first aperture.

The second portion of the tool body can include a second aperture transverse to, and at least partially through, the first aperture. The second aperture would be configured to receive the cutting blade, thereby facilitating cutting of a dispensing end of a caulk tube inserted into the first aperture. The cutter arrangement further can include an actuator at least partially disposed outside the tool body and configured to move the cutting blade through the second aperture when a first force is applied to the actuator. To return the cutter arrangement to its original position, at least one spring, or other biasing member, can be disposed to be in contact with the actuator, thereby providing a return force after the tip of the caulk tube is cut. The finishing head my be made up of a plurality of bristles attached to the first portion of the tool body with a bristle clamp. Alternatively, the finishing head can be made up of a solid polymeric material, or other flexible material effective to provide a finished surface to a bead of caulk.

The invention also provides a caulk tool including a tool body having a first portion and a second portion adjacent the first portion. The first portion includes a flexible finishing head configured to be applied to a bead of caulk, thereby providing a finished appearance to the caulk. The second portion has a first aperture disposed therethrough, and is configured to receive a dispensing end of a caulk tube. At least one cutting blade is disposed within the tool body and configured to remove a portion of the dispensing end of the caulk tube.

The present invention also provides a way for smoothing out caulk and other sealants with a built-in cutting mechanism. In one embodiment, the tool includes a main body with a bristle structure at one end and a push button cutting blade with an access hole to the cutting blade at the other end. The mechanism provides a clean method for smoothing out caulk and other sealants with the use of the bristle structure. The bristle structure is located at one end of a hand-held body that is used to run down caulk or sealant beads to give a smooth finish thereto.

The invention further provides a safe and effective way of cutting the tip off a tube to caulk or a sealant. The tool includes a spring-loaded push button attached to a cutting blade and located on the top of the main body. When the button is depressed, the blade travels downward and may be directed by at least one guide inside the main body. An access hole to the blade is located in the rear end of the main body opposite of the bristle end; this access hole allows the tip of caulk and sealant tubes to be inserted therein. Once the tip is inserted, the button is then depressed, cutting the tip at a desired distance and angle.

DETAILED DESCRIPTION OF THE PREFERRED EMBODIMENT(S)

FIG. 1 shows a caulk tool 10 in accordance with one embodiment of the present invention. The tool 10 is shown being held in a user's hand 12. As used herein, the term "caulk" is meant to encompass a wide variety of materials, including sealants and other filler materials. For example, as used in this application, "caulk" may include silicone, latex, or other materials—e.g., polymers and/or composites. In the embodiment shown in FIG. 1, caulk tool 10 includes a tool body 14, including a first portion 16 and a second portion 18 adjacent the first portion 16. The tool body 14, which defines a longitudinal axis 15, can be constructed of a polymeric material or materials, but it may also be constructed of wood, metal, or other suitable materials. The first and second portions 16, 18 form a posterior portion 17 of the tool body 14. The posterior portion 17 has a thickness ($t_1$) that is thicker than an anterior portion 19, which has a thickness ($t_2$). The tool body 14 also includes an intermediate portion 21, which, in the embodiment shown in FIG. 1, includes a generally flat surface 23 forming an oblique angle with the longitudinal axis 15. The tool body 14 may be cast from a mold in two parts, where all internal parts—described in detail below—are added in a secondary operation. The two sections can then be bound together by chemical agents, sonic welding, or by other suitable means.

The first portion 16 of the tool body 14 includes a flexible finishing head 20, which, in the embodiment shown in FIG. 1, includes a plurality of bristles 22. The bristles 22 extend outwardly from an end 24 of the first portion 16 of the tool body 14. A caulk tool, such as the tool 10, could also have a finishing head extending from both ends, instead of just one, as shown in FIG. 1. The bristles 22 may be constructed of a polymeric material, such as a nylon blend, but can be constructed of other materials, such as animal hair and/or synthetic blends. As an alternative to bristles, a flexible solid material, such as an elastomeric polymer, may be used. A bristle clamp 26 is wrapped around the end 24 of the tool body 14, and also around the bristles 22. The bristle clamp 26 may be constructed of metal, or any material or materials effective to attach the bristles 22 to the end 24. The bristle clamp 26 may be omitted if the bristles 22 are melted or molded into the tool body 14 itself. As shown in FIG. 1, the caulk tool 10 fits conveniently into a user's hand. In one embodiment, the tool 10 may be approximately 6 inches long, with the finishing head 20 being 1 to 1½ inches long and ¼-½ inches in diameter.

Figure 2:
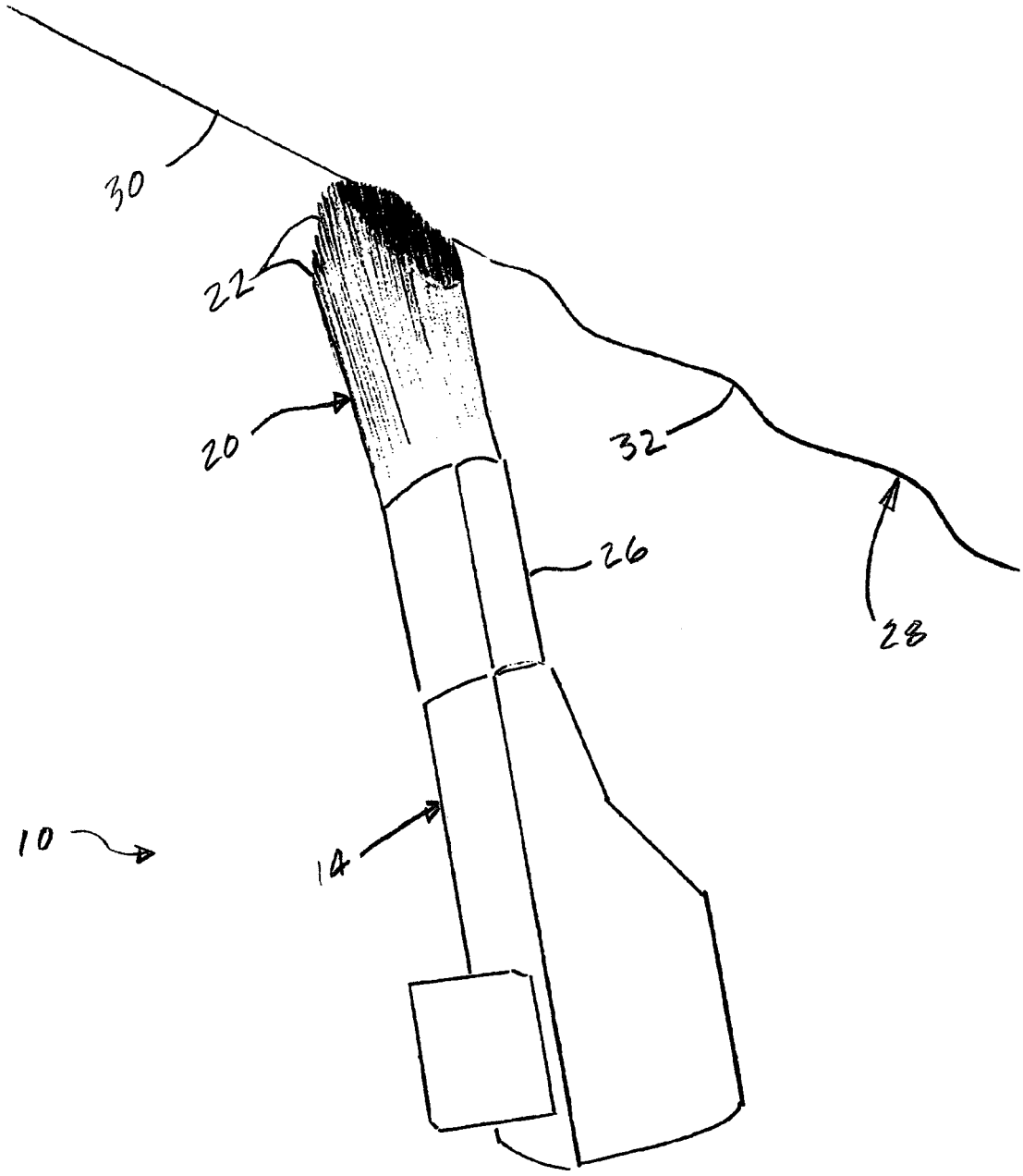
FIG. 2 is a perspective view of the tool shown in FIG. 1 being used on a bead of caulk.

FIG. 2 shows the tool 10 being used to apply a finish to a bead of caulk 28. Although the caulk 28 is shown in FIG. 2 generally forming a line, or bead, it is understood that the tool 10 can be used on caulk that is applied in some other shape or configuration. The caulk 28 is initially wavy, as shown by a first portion 32 in front of the tool 10. As the finishing head 20 is drawn over the caulk 28, the caulk is smoothed, as shown by a second portion 30 behind the tool 10. The bristles 22 are used to smooth out the caulk 28, or other material, by brushing out the material. The finishing head 20 can be dipped into a thinner, such as water, before it is used to brush out the material. The thinner acts as a lubricant, giving the material a better finished appearance. The bristles 22 may be cut at a 45 degree angle with a point in the middle, but they can be cut at any angle desired, or even left flat, depending on the requirements of the application. The length of the bristles 22 can also vary to fit different needs. The bristle clamp 26 can be fastened to the end 24 of the tool body 14 by glue, rivets, or other fastening devices.

Figure 3A:
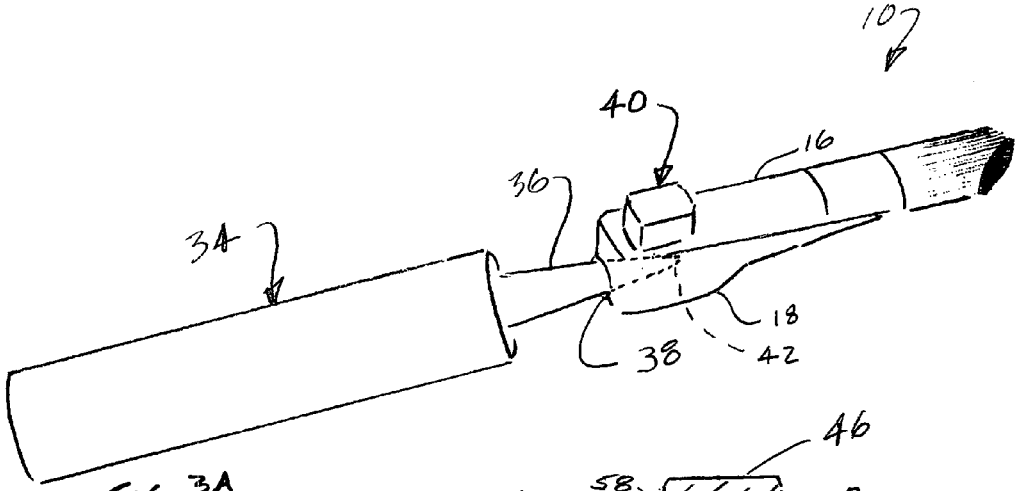
FIGS. 3A-3C are views of the caulk tool shown in FIGS. 1 and 2, showing a tip of a caulk tube being removed.

FIG. 3A shows a tube of caulk 34 with a dispensing end 36 inserted into a first aperture 38 disposed in the second portion 18 of the tool body 14—see also FIG. 1. The caulk tool 10 includes a cutter arrangement 40 configured to remove a tip 42 of the dispensing end 36 of the caulk tube 34. In the embodiments shown in FIGS. 3A and 3B, the cutter arrangement 40 includes a movable blade 44, which is attached to an actuator, or push button 46. The button 46 is partially disposed outside the tool body 14 to facilitate access by a user. When a user pushes the button 46 inward, the blade 44 is moved in a direction transverse to the first aperture 38. The blade 44 is configured to pass through a second aperture 48 which is configured to receive the blade 44. In the embodiment shown in FIG. 3B, guides 50, 52 are inserted in the aperture 48 to provide a close tolerance fit and to help guide the blade 44 as it cuts the tip 42 of the caulk tube 34. A cutter arrangement, such as the cutter arrangement 40, may include a slide or scissors mechanism—e.g., like a cigar cutter—as an alternative to the button 46 and blade 44 shown in FIG. 3B. Alternatively, a stationary blade may be used, thereby simplifying the cutter arrangement.

Figure 3B:
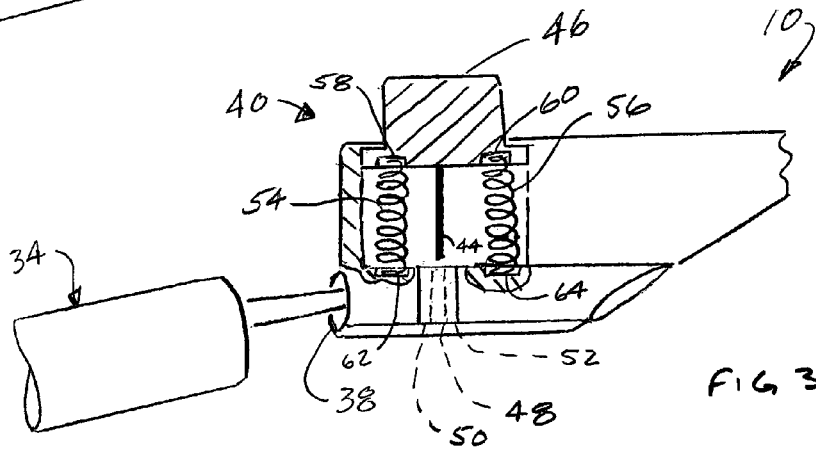
Figure 3C:
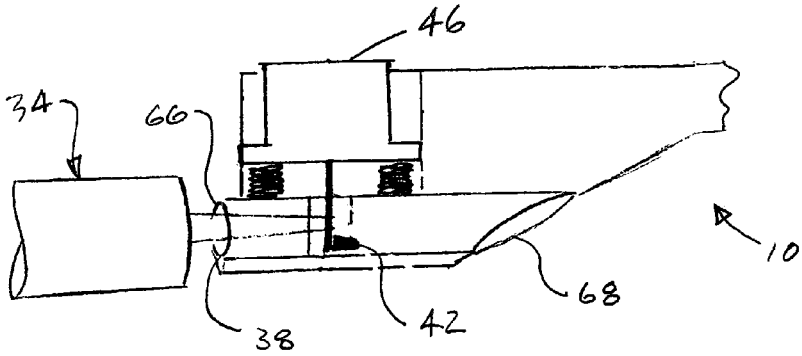

As shown in FIG. 3B, the cutter arrangement 40 includes a pair of biasing members, or springs 54, 56. The springs 54, 56 are held in place by indentations 58, 60, 62, 64. The springs 54, 56 are configured to return the button 46 to the position shown in FIG. 3B after a user applies a force to cut the tip 42 of the caulk tube 34—see also FIG. 3C. As shown in FIG. 3C, the first aperture 38 is a through hole, having two open ends 66, 68. This not only facilitates manufacturing of the tool body 14, but also allows the dispensing end 36 of the caulk tube 34 to be inserted into one end 66, while the tip 42 cut off by the blade 44 exits the tool body 14 through the other end 68. The first aperture 38 can be large enough to allow a user to insert the dispensing end 36 into the aperture 38 at virtually any convenient angle. Moreover, the aperture 38 could itself be bored at a standard angle to facilitate cutting of tube ends with a consistent angle.

While embodiments of the invention have been illustrated and described, it is not intended that these embodiments illustrate and describe all possible forms of the invention, rather, the words used in the specification are words of description rather than limitation, and it is understood that various changes may be made without departing from the spirit and scope of the invention.

What is claimed is:

1. A caulk tool separate from a caulk dispenser, the caulk tool comprising:

a tool body defining a longitudinal axis, and including a first portion and a second portion adjacent the first portion, the first and second portions forming a posterior portion of the tool body, the tool body further including an anterior portion and an intermediate portion connecting the posterior and anterior portions, the posterior portion of the tool body having a thickness greater than a thickness of the anterior portion, the tool body being sized such that the entire tool body fits substantially within a user's hand;

a cutter arrangement at least partially disposed within the tool body and including a cutting blade moveable in a direction transverse to the longitudinal axis of the body for removing a portion of a caulk dispenser; and a flexible finishing head extending outward from the tool body in a direction generally parallel to the longitudinal axis of the tool body, and configured to be applied to a bead of caulk, thereby providing a finished appearance to the caulk.

2. The caulk tool of claim 1, wherein the second portion of the tool body includes a first aperture configured to receive a dispensing end of a caulk tube to facilitate removal of a portion of the dispensing end at a standard angle for a dispensing end of a caulk tube, the first aperture having two at least partially open ends such that the dispensing end of a caulk tube can be inserted into one end of the first aperture, and a removed portion of the dispensing end can exit the tool body through the other end of the first aperture.

3. The caulk tool of claim 2, wherein the first aperture is disposed generally parallel to the longitudinal axis of the tool body.

4. The caulk tool of claim 1, wherein the second portion of the tool body includes a second aperture transverse to and at least partially through the first aperture, the second aperture being configured to receive the cutting blade, thereby facilitating cutting of a dispensing end of a caulk tube inserted into the first aperture.

5. The caulk tool of claim 4, wherein the cutter arrangement further includes an actuator at least partially disposed outside the tool body and configured to move the cutting blade through the second aperture when a first force is applied to the actuator.

6. The caulk tool of claim 5, wherein the cutter arrangement further includes at least one biasing member in contact with the actuator for returning the actuator to a starting position after the first force is removed.

7. The caulk tool of claim 1, wherein the finishing head includes a plurality of bristles.

8. The caulk tool of claim 1, wherein the tool body is sized to be between approximately four and seven inches long to accommodate the user's hand, thereby providing control over the finishing of the caulk.

9. The caulk tool of claim 1, wherein at least one side of the finishing head is disposed at an oblique angle to the longitudinal axis of the tool body, such that a portion of the finishing head in contact with the caulk is approximately parallel to the caulk when the user applies the finishing head to the caulk.

10. The caulk tool of claim 1, wherein the anterior portion includes a generally flat surface disposed at an oblique angle to the longitudinal axis of the tool body.

11. A caulk tool separate from a caulk dispenser, the caulk tool comprising:

a tool body defining a longitudinal axis, and having a first portion and a second portion adjacent the first portion, the second portion having a first aperture disposed therethrough and configured to receive a dispensing end of a caulk tube, the first and second portions forming a posterior portion of the tool body, the tool body further including an anterior portion and an intermediate portion, the posterior portion of the tool body having a thickness greater than a thickness of the anterior portion, thereby facilitating a secure grip by the user's hand, the intermediate portion providing a transition between the posterior and anterior portions, the tool body being sized such that the entire tool body fits substantially within a user's hand;

a flexible finishing head extending outward from the first portion and generally parallel to the longitudinal axis of the tool body, and configured to be applied to a bead of caulk, thereby providing a finished appearance to the caulk; and at least one cutting blade disposed within the tool body and moveable in a direction transverse to the longitudinal axis of the body, configured to remove a portion of the dispensing end of the caulk tube.

12. The caulk tool of claim 11, wherein the finishing head includes a plurality of flexible bristles.

13. The caulk tool of claim 11, wherein the at least one cutting blade includes a cutting blade movable transverse to the first aperture for removing a portion of a dispensing end of a caulk tube after the dispensing end is inserted into the first aperture.

14. The caulk tool of claim 13, wherein the second portion of the tool body includes a second aperture transverse to and at least partially through the first aperture, the second aperture being configured to receive the cutting blade, thereby facilitating cutting of a dispensing end of a caulk tube inserted into the first aperture.

15. The caulk tool of claim 14, further comprising an actuator at least partially disposed outside the tool body and configured to move the cutting blade through the second aperture when a first force is applied to the actuator.

16. The caulk tool of claim 13, wherein the cutting blade is movable transverse to the first aperture at a standard angle for a dispensing end of a caulk tube.

17. The caulk tool of claim 11, wherein the tool body is sized to be between approximately four and seven inches long to accommodate the user's hand, thereby providing control over the finishing of the caulk.

18. The caulk tool of claim 11, wherein at least one side of the finishing head is disposed at an oblique angle to the longitudinal axis of the tool body, such that a portion of the finishing head in contact with the caulk is approximately parallel to the caulk when the user applies the finishing head to the caulk.

19. The caulk tool of claim 11, wherein the anterior portion includes a generally flat surface disposed at an oblique angle to the longitudinal axis of the tool body.

20. The caulk tool of claim 11, wherein the first aperture is disposed generally parallel to the longitudinal axis of the tool body.

* * * * *

UNITED STATES PATENT AND TRADEMARK OFFICE

CERTIFICATE OF CORRECTION

PATENT NO. : 7,644,464 B2
APPLICATION NO. : 11/271721
DATED : January 12, 2010
INVENTOR(S) : Joseph W. Bommarito It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 356 days.

Signed and Sealed this

Twenty-first Day of December, 2010

David J. Kappos

David J. Kappos
*Director of the United States Patent and Trademark Office*